United States Patent [19]

Pearson

[11] 4,096,596

[45] Jun. 27, 1978

[54] FURNITURE DECK EDGING

[75] Inventor: George R. Pearson, High Point, N.C.

[73] Assignee: Flex-O-Lators, Inc., Carthage, Mo.

[21] Appl. No.: 767,127

[22] Filed: Feb. 9, 1977

[51] Int. Cl.[2] ..... A47C 25/00

[52] U.S. Cl. ..... 5/360; 5/354

[58] Field of Search ..... 5/354, 360

[56] References Cited

U.S. PATENT DOCUMENTS

| | | | |
|---|---|---|---|
| 2,724,130 | 11/1955 | Richardson | 5/360 |
| 2,871,925 | 2/1959 | Richardson | 5/360 |
| 3,665,530 | 5/1972 | Basner | 5/360 |

*Primary Examiner*—Casmir A. Nunberg
*Attorney, Agent, or Firm*—John A. Hamilton

[57] ABSTRACT

A furniture deck edging strip providing for pillow retention, cushioning and wear protection between the wire or other structural elements of a furniture deck, at the edges of the top load surface of the deck, and padding layers applied over the deck in the finishing of the furniture, the edging strip being elongated and of uniform cross-sectional contour, being formed of a flexibly resilient material, and having a pair of laterally spaced apart projecting fins or flaps, one of which forms a re-entrant notch with the body of the strip for interlocking engagement over the edge of the deck to secure the strip to the deck, and the other fin being attachable to the deck by clips or the like, so that the notch is locked in engagement with the deck. The strip may be provided with a tough surface layer to provide good purchase for the clips, and structural strength for the rib forming the notch.

4 Claims, 4 Drawing Figures

FURNITURE DECK EDGING

Figure 1:
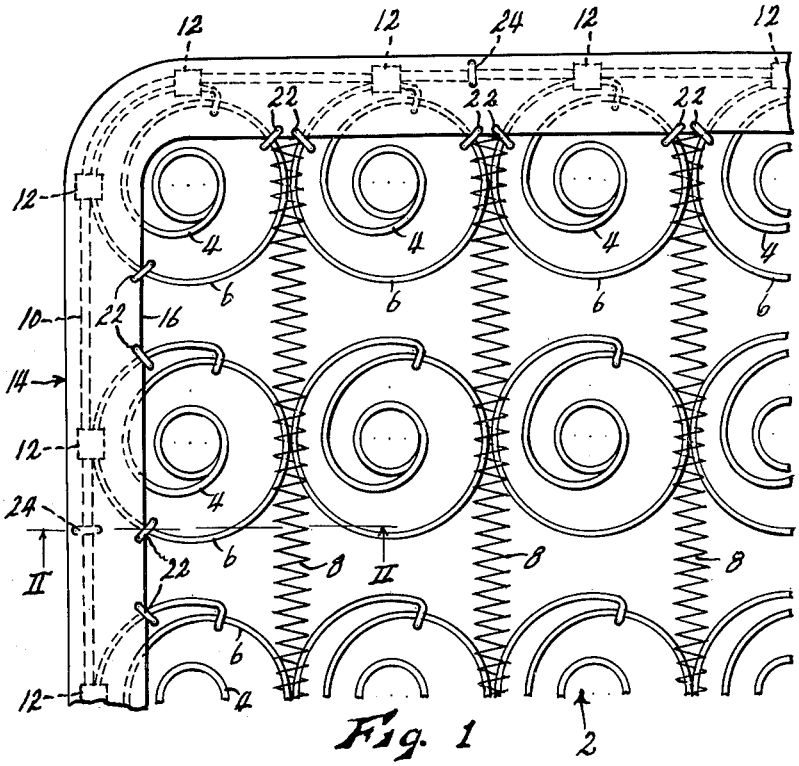

This invention relates to new and useful improvements in furniture and upholstery accessories, and has particular reference to the class of goods commonly known as furniture deck edging.

In furniture utilizing spring decks over which layers of padding material are applied, the use of deck edging of some type is common. Said edging constitutes a strip of tough padding material secured to the top surface of the deck, around the edge thereof, and overhanging outwardly from said edge, before the bulkier, softer main padding layers are applied thereover. The edging has the functions of providing a raised ledge around the top load surface of the seat, whereby to assist in positioning and retaining a loose cushion or pillow placed thereon, as in upholstered sofas or chairs, of preventing or reducing wear, and possibly even eventual penetration, of the padding layers by the wires of the spring deck, and of providing a desirable "soft-edge" effect for greater comfort. Thus any necessity of using extra thick main padding layers at the deck border, where the wear protection and padding effect described above is particularly required, is eliminated. The present invention is primarily concerned with the provision of an edging strip having an improved physical makeup and structure.

The deck edging presently in the most common usage constitutes an elongated strip the core of which is formed of jute, "waffled" paper, or soft, loosely compacted paper or synthetic fabrics, capable of providing a padding or cushioning effect, covered by a sheath layer of relatively tough paper, burlap or synthetic fabric. Such edging is ordinarily secured to wires of the spring deck by wire clips, commonly known as "hog rings", which pierce the edging strip and encircle wires or other elements of the spring deck. The edging strip is ordinarily provided with outwardly projecting longitudinal ribs or "fins", for convenience of applying the hog rings. Such attaching fins can be formed of the cover material itself, and in some cases are made by sewing tough rope strands into projections of the cover material.

However, edging as described above is subject to certain disadvantages. It is relatively difficult and expensive to manufacture, due to the multi-folding of the paper or the like forming the core, enclosing the core in the relatively tough sheath, and securing the assembly, usually by sewing. These operations are further complicated by the necessity of providing the ribs or fins as anchors for the hog rings. Paper or other core materials commonly used are sufficiently tough and provide some padding effect, but are ineffective in providing the flexibility that will permit the edging to conform easily to the deck shape. The strip tends to wrinkle badly when it is curved around corners of a spring deck, since neither the core nor the sheath are actually resiliently elastic. This wrinkling, particularly evident at the insides of corners, greatly increases the minimum radius to which the strip can be curved. Secure mounting thereof on the deck, to anchor it against displacement under the stresses of normal usage, requires that it be affixed to the deck along two spaced apart parallel longitudinal lines, whereby to prevent twisting, two spaced apart fins or ribs for receiving hog rings usually being utilized for this purpose, so that attachment to the deck is rendered a tedious and time-consuming operation. The edging is relatively heavy, rendering handling thereof relatively difficult. It is relatively tough, and hard to cut with knife or scissors, so that the cutting and fitting thereof by an upholsterer may require special tools. It absorbs water, and therefore may rot or mildew. It may have an objectionable odor, or absorb odors, or acquire an objectionable odor if it absorbs moisture and rots or mildews. It may be permanently deformed and rendered useless if severely kinked or compressed during handling. It may tend to become disassembled or ravelled at its ends when it is cut to desired lengths during application, due to severance of the sewing threads with which it is assembled.

Accordingly, the object of the present invention is the provision of a furniture deck edging strip which overcomes all of the above ennumerated difficulties, problems and disadvantages attending the use of prior edging strips. Generally, this object is accomplished by forming the strip of a one-piece continuous extrusion, whereby all assembly operations are eliminated, of a chemically homogenous composition throughout, of a flexible foamed polymer such as polyethylene or polyurethane having gasfilled cells throughout its mass, the interior thereof forming its core having relatively large and numerous cells whereby it is rendered softly resilient to provide resilient bulk for cushioning and padding purposes and to render the strip formable around corners of a spring deck without wrinkling, whereas a surface layer thereof has relatively few and small gas cells to render it sufficiently tough to provide adequately secure anchorage for the hog rings used to secure it to the spring deck. The ribs or "fins" are also formed during the extrusion and toughened by the surface layer. One of said ribs is specially configurated to "interlock" with the spring deck assembly to be affixed thereto without the use of hog rings or other added fasteners, whereby to simplify the attachment of the strip to the deck.

Figure 2:
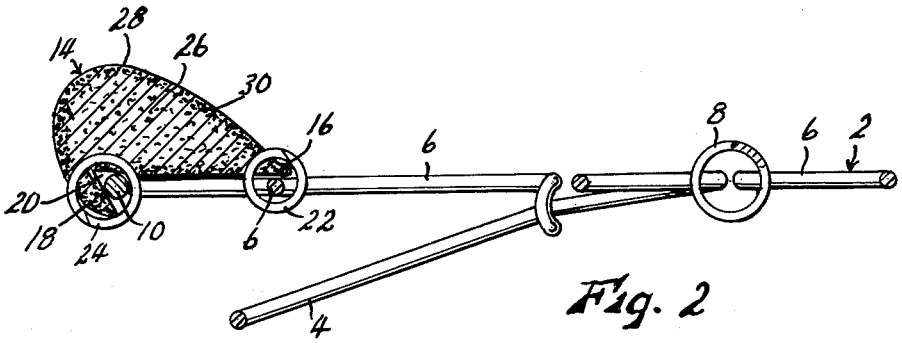
Figure 3:
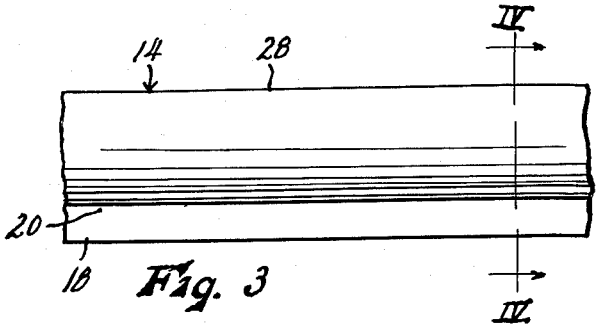
Figure 4:
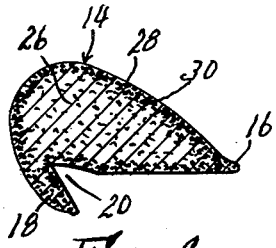

With these objects in view, as well as other objects which will appear in the course of the specification, reference will be had to the accompanying drawing, wherein:

FIG. 1 is a fragmentary top plan view of a furniture spring deck, showing an edging strip embodying the present invention applied operatively thereto, FIG. 2 is an enlarged, fragmentary sectional view taken on line II—II of FIG. 1, FIG. 3 is an enlarged inside elevational view of a section of the edging strip, and FIG. 4 is a sectional view taken on line IV—IV of FIG. 3.

Like reference numerals apply to similar parts throughout the several views, and the numeral 2 applies generally to a furniture spring deck of a common type, consisting of a series of coil springs 4 arranged with their axes vertical and parallel. Said springs are arranged as shown in FIG. 1, in rows at right angles to each other. The top convolutions 6 of all of the springs are substantially circular, and lie in a horizontal plane defining the load supporting surface of the deck. The top convolutions in the rows of springs appearing as horizontal in FIG. 1 are disposed in substantially tangential, abutting relation, and each consecutive pair of springs in each of the "horizontal" rows are joined by a helical spring wire binder coil 8, said coils extending horizontally (though appearing as vertical in FIG. 1) so as to join corresponding pairs of springs in all of the "horizontal" rows. Said binder coils encircle and connect portions of the top convolutions 6 of the related spring pairs, and may be rotated or "screwed" into assembly with the springs. This is a common construction. A heavy spring border wire 10 extends around the periphery of the top surface of the deck, being affixed to the top convolutions 6 of the marginal springs by clips 12. It will be understood, though not shown, that the lower ends of springs 4 may be affixed to a suitable rigid base. The use of a border wire as shown, or of some similar type, which furthermore is "overhanging" outwardly, in the sense that there are no structural elements directly therebeneath, is virtually universal in spring decks.

It will also be understood that padding layers, not shown, are to be applied over the top load surface of the deck, and formed around border wire 10 to overlie the side edge of the deck. To retain a loose cushion or pillow, as laid over the deck in upholstered sofas and chairs, from sliding forwardly and off of the deck, and to close the visual gap that would otherwise appear between the forward deck edge and the lower front edge of a "crowned" loose cushion or pillow, and also to protect the padding layers from wearing contact with the border wire and further to provide a desirable "soft-edge" feel for the deck, a cushioned or padded edging strip generally designated by the numeral 14 is commonly applied over the peripheral edge portion of the load supporting surface of the deck, before the padding layers are applied. The present invention is directed to an edging strip having a new and novel formation and make-up.

The cross-sectional contour of edging strip 14, as shown, is generally conventional, being generally of "tear drop" contour, with its horizontally outward edge being thick and rounded, and tapering to a vertically thin section at its horizontally inward edge to form a rib or "fin" 16 which extends along the entire length of the strip. Another longitudinally extending fin 18 is formed along the lower side of the strip, spaced transversely apart from fin 16, but spaced inwardly from the vertical plane of the extreme outer edge of the strip. Fin 18 is positioned to depend past the outer edge of border wire 10, and as a special feature of the present invention, is inclined downwardly and inwardly toward fin 16, as shown, thereby forming a re-entrant groove 20 between fin 18 and the body portion of the strip, border wire 10 being engaged interlockingly in said groove. Fin 16 is secured to the top convolutions 6 of the marginal deck springs at intervals along its length by a series of split wire clips 22 commonly known as "hog rings". Such clips are originally spread open, but may be closed by a special plier-like tool to encircle a wire of the deck spring and pierce edging strip 14, either through fin 16 itself, or through the body portion of the strip adjacent the fin, so that the entire fin, or a major portion of it, is enclosed within the clip. Thus the strip may be completely affixed to the spring deck along both of the fins 16 and 18 by hog rings 22 only, which engage only fin 16, but not fin 18. Fin 18 is interlocked around border wire 10 to secure said border wire in groove 20, this engagement being secured by hog rings 22, which prevent outward horizontal movement of the strip relative to the deck. Fully secure mounting of the strip, to lock the strip in place and to prevent twisting thereof under the stresses applied thereto in normal usage, requires fastening the strip along both of fins 16 and 18, but with fin 18 specially formed as described it is secured in interlocking relation around the border wire 10 by the hog rings 22 applied to fin 16. The tension of the padding and upholstery layers which are later applied over the deck and around the edging also tends to maintain fin 18 in interlocking relation to the border wire. If still greater security of mounting of the strip is desired, extra hog rings 24 may be used to secure fin 18 directly to the border wire, as shown. However, even if such extra hog rings are deemed necessary, a far smaller number of such hog rings will suffice than would be required if fin 18 did not engage about the border wire.

As contemplated by the present invention, edging strip 18 is formed of a flexible, resilient foamed polymer such as polyethylene or polyurethane, or blends thereof, or possibly other polymers, the specific chemical composition not being pertinent to the present invention, so long when foamed it possesses a spongy form, with gas-filled cells distributed throughout its mass except at its extreme surface skin, which is ordinarily non-porous and waterproof if the product is produced by ordinary methods such as extrusion or continuous molding processes. Thus the edge strip 14 includes a highly porous, low density, highly resilient interior body or core portion 26, in which the gas cells are relatively numerous and large, and a waterproof skin 28. The strip is also provided with a surface layer 30, just inside of skin 28 but much thicker than said skin, which is "densified" to form a relatively dense, tough layer in which the gas-filled cells are much smaller and more widely spaced than in body core 26. Surface layer 30 may be provided by several methods, such as by chemical variation of the raw material of the strip, or by temperature control during the extrusion or molding thereof, but the use of any specific method is not pertinent to the present invention.

In use, it will be seen that core portion 26, due to its highly porous, low density consistency, provides the resilient cushioning effect desired as a general characteristic of the edging strip. However, because of this same consistency, it is locally quite weak in structural strength and is easily torn. Hence it of itself would not provide a secure anchorage for the hog rings, nor might it impart sufficient structural strength to fin 18 to hold it firmly in interlocking engagement with border wire 10. Hence the strip might tend to tear free from hog rings 22, and to become disengaged from the border wire, under the shifting and repetitive loads of normal usage. Likewise, skin 28, being non-porous provides the desired waterproofing effect, but adds little to the structural strength of the strip. However, surface layer 30, being relatively dense and much thicker than the skin, supplies fully adequate strength and toughness to provide acceptably secure anchorage for the hog rings and for fin 18. In fact, by confining and restricting the relatively weak and porous core 26, the surface layer 30 improves the stregth of the core material itself. Nevertheless, the surface layer 30 is quite flexible, and hence does not materially reduce the general cushioning effect of the core.

Presuming that surface layer 30 is of uniform thickness around the entire periphery of the edging strip, and since fins 16 and 18 are much thinner than the body portion, it will be seen that said surface layer occupies a much greater proportion of the total volume of the fins than of the body portion of the strip. This renders the fins relatively stiff as compared to the body portion, which is an advantage in securely "locating" the strip in the desired relation to the spring deck. In fact, the surface layer can occupy the entire volumes of the fins. If the fins were too limply flexible, a greater number of closely spaced hog rings would be required, and fin 18 would not securely interlock about the border wire. This is particularly important in connection with fin 18, which serves as the primary "locator" of the strip. Since the toughness supplied by surface layer 30 functions primarily to provide secure anchorage for hog rings 22, and to provide structural strength for fin 18 to improve its interlocking engagement with border wire 10, it will be apparent also that said surface layer could be provided only at and adjacent ribs 16 and 18.

The edging strip as disclosed also has other advantages. Being a one-piece structure, of homogenous chemical composition throughout, it is highly economical as compared to relatively complicated prior structures built from a plurality of elements, and it may be mass produced by well known, well understood and economical procedures. It can be curved or bent around corners of a spring deck substantially without wrinkling or folding thereof at the inside of the curves or bends, even if the bend or curve is of small radius, since the surface and skin layers are in effect intimately bonded to the core over their entire areas, rather than only at specific and limited areas as in prior structures, and since the material is resiliently elastic. It may be easily cut with ordinary knives or scissors, as a convenience to upholsterers. When cut, it will not ravel or fray, due to its one-piece construction. It is waterproof, due to its nonporous skin, and hence cannot rot or mildew. The materials suggested are odorless, and will not absorb other odors, will recover their normal form if they have been severely kinked or compressed during handling, and are non-allergenic.

While I have shown and described a specific embodiment of my invention, it will be readily apparent that many minor changes of structure and operation could be made without departing from the spirit of the invention.

What I claim as new and desire to protect by Letters Patent is:

1. In combination with a furniture deck having a top load-supporting surface and a border member extending along and attached to the marginal edge of said load-supporting surface, and edging strip comprising:

a. an elongated body portion extending along and overlying said border member and the marginal edge portion of said deck, and being formed of a padding material, b. a first longitudinal fin integral with said body portion adjacent the horizontally outward edge thereof and at the bottom surface thereof and being inclined downwardly and inwardly from said body portion toward the horizontally inward edge of said body portion, whereby a groove is formed between said fin and said body portion, said border member being engaged in said groove, c. a second longitudinal fin integral with said body portion at the horizontally inward edge thereof, in transversely spaced relation from said first fin, said body portion and said first and second fins of said strip being of one-piece construction of a resilient, porous material of chemically homogenous nature throughout their entire volumes, with gas-filled cells distributed therein, the material forming said fins being densified by a reduction of the volume of the gas-filled cells therein, whereby to be rendered relatively stiff and tough as compared to said body portion, and d. fastener means securing said second fin to elements of said deck, whereby horizontally outward movement of said strip relative to said deck is prevented, and said first fin is secured in engagement with said border member.

2. In combination with a furniture deck having a top load-supporting surface and a border member extending along and attached to the marginal edge of said load-supporting surface, an edging strip comprising:

a. an elongated body portion extending along and overlying said border member and the marginal edge portion of said deck, and being formed of a padding material, b. a first longitudinal fin integral with said body portion adjacent the horizontally outward edge thereof and at the bottom surface thereof, and being inclined downwardly and inwardly from said body portion toward the horizontally inward edge of said body portion, whereby a groove is formed between said fin and said body portion, said border member being engaged in said groove, c. a second longitudinal fin integral with said body portion at the horizontally inward edge thereof, in transversely spaced relation from said first fin, said body portion and said first and second fins being of one-piece construction of chemically homogenous material throughout, being formed of a resilient, porous material having gas-filled cells distributed therein, and having a surface layer of generally uniform thickness which is densified by reduction of the volume of the gas-filled cells therein, whereby to be rendered relatively stiff, strong and tough, the thickness of said fins being small as compared to that of said body portion so that a larger proportion of the volume of said fins is formed by said surface layer than of said body portion, whereby said fins are rendered relatively stiff and tough as compared to said body portion, and d. fastener means securing said second fin to elements of said deck, whereby horizontally outward movement of said strip relative to said deck is prevented, and said first fin is secured in engagement with said border member.

3. The combination as recited in claim 2 wherein said edging strip is provided with an extreme outer skin, covering said surface layer and integral therewith, which is non-porous and waterproof.

4. The combination as recited in claim 3 wherein said edging strip is formed of a foamed polymer selected from a class including polyethylene and polyurethane.

* * * * *